United States Patent [19]

Ciarcia et al.

[11] 3,973,230

[45] Aug. 3, 1976

[54] CIRCUIT BREAKER ACCESSORIES INCORPORATING IMPROVED AUXILIARY SWITCH

[75] Inventors: Ronald David Ciarcia, Bristol; James Edward McGann, Jr., Plainville, both of Conn.

[73] Assignee: General Electric Company, New York, N.Y.

[22] Filed: Apr. 25, 1974

[21] Appl. No.: 571,736

[52] U.S. Cl. ..... 335/13; 335/17; 335/25

[51] Int. Cl.[2] ..... H01H 75/00

[58] Field of Search ..... 335/13, 17, 25, 37, 335/173

[56] References Cited

UNITED STATES PATENTS

| | | | |
|---|---|---|---|
| 3,256,407 | 6/1966 | Klein | 335/173 |
| 3,288,965 | 11/1966 | Klein | 335/37 X |
| 3,388,357 | 6/1968 | Lawson et al. | 335/13 |
| 3,436,695 | 4/1969 | Dessert | 335/9 |
| 3,530,412 | 9/1970 | Gryctko | 335/13 |
| 3,720,891 | 3/1973 | Nicol | 335/13 |
| 3,820,046 | 6/1974 | Layton et al. | 335/13 |

*Primary Examiner*—J. D. Miller
*Assistant Examiner*—Fred E. Bell
*Attorney, Agent, or Firm*—Robert A. Cahill; Walter C. Bernkopf; Frank L. Neuhauser

[57] ABSTRACT

An auxiliary switch is incorporated in an accessorial molded circuit breaker case juxtaposed with one or more molded case circuit breakers and operatively interconnected therewith by an internal common trip bar and an external handle tie. The auxiliary switch arm is variously positioned by the common trip bar in relation to a contact variously positioned by the accessorial case handle so as to selectively control an external operating or indicating circuit depending on the relative positions of the trip bar and accessorial case handle. The auxiliary switch may be utilized in a shunt trip solenoid energizing circuit or in a trip alarm circuit.

14 Claims, 5 Drawing Figures

FIG. 1
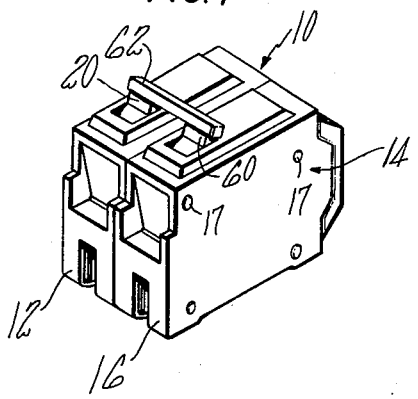
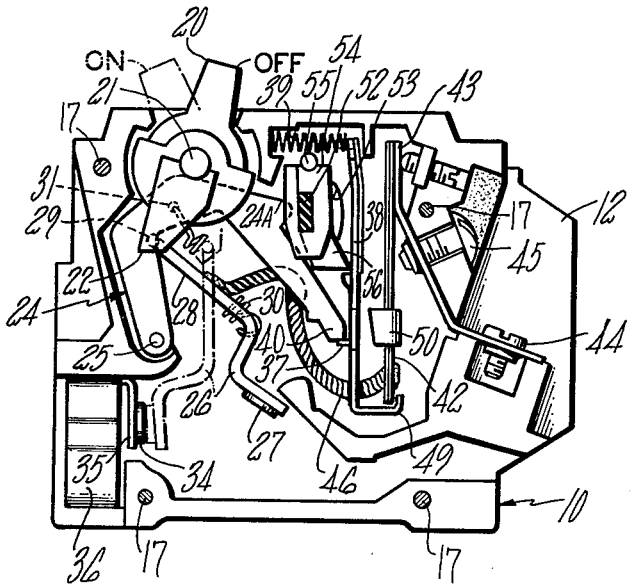
FIG. 2

FIG. 3
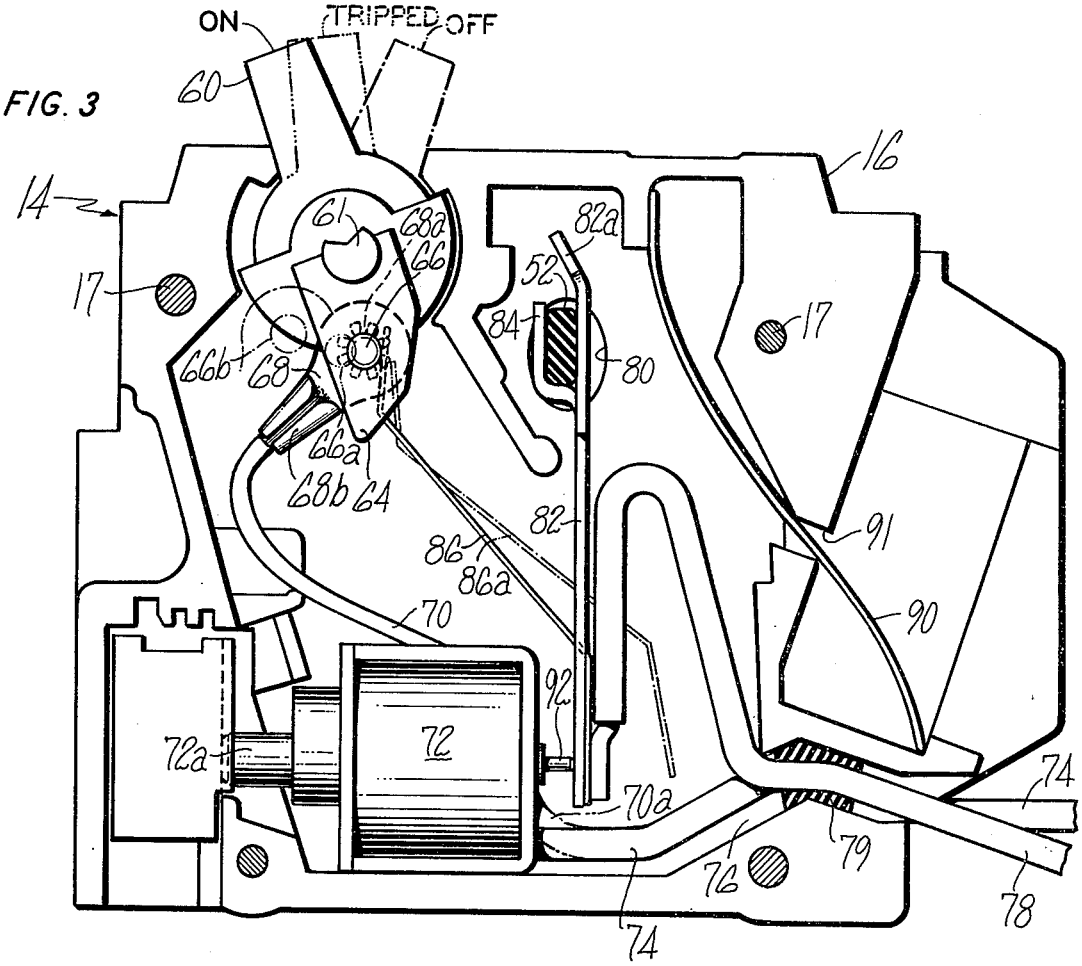
FIG. 4
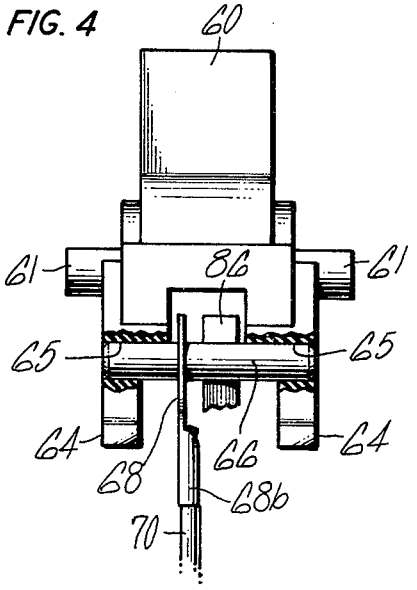
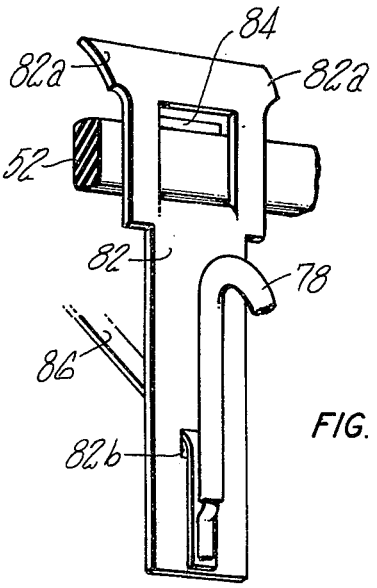
FIG. 5

CIRCUIT BREAKER ACCESSORIES INCORPORATING IMPROVED AUXILIARY SWITCH

BACKGROUND OF THE INVENTION

It is becoming increasingly more common to utilize automatic electric circuit breakers to serve various auxiliary functions in addition to their traditional circuit protective role. This trend is most pronounced with higher current rated, industrial circuit breakers, but now is increasingly being evidenced in applications calling for the lower current rated, residential type circuit breakers. Such auxiliary functions typically fall into two general categories; one being an "operating" function of which remote or shunt trips are the most common example, and the other being an "indicating" function best exemplified by trip alarms.

For those installations calling for residential type circuit breakers, it is now common practice as illustrated in U.S. Pat. No. 3,256,407, to house the accessory device in a dummy or accessorial molded circuit breaker case affixed in side-by-side relation with a circuit breaker housed in a similarly configured molded case. This is done, quite simply, because there is typically no room within the circuit breaker case to accommodate accessory devices. Additional, identical molded case circuit breakers may be added in side-by-side relation for two and three-pole installations. The accessory device in its case is operatively connected with the circuit breaker or breakers by an internal common trip bar. Additionally, the accessorial case is equipped with an external handle which is forced to follow the positionings of the circuit breaker operating handle(s) via an external handle tie.

In the trip alarm adaptation, a conventional, off-the-shelf microswitch is positioned in the accessorial case and is adapted to be actuated either directly or indirectly via the internal common trip bar incident to automatic operation of one of the circuit breakers to effect circuit interruption in response to an overcurrent condition. This switch controls an indicator or alarm circuit to manifest at a remote location the fact that a circuit breaker or circuit breakers have tripped. Alternatively, the switch may be actuated in response to movement of the accessorial case handle from its ON position to its tripped or OFF position.

In a typical implementation, the accessorial case includes a dummy circuit breaker operating mechanism. The common trip bar extending into the accessorial case is normally effective to maintain this dummy operating mechanism in a latched condition, such that its contact arm assumes a first position corresponding to the closed circuit positions of the contact arms of the adjacent circuit breakers when the ganged operating handles are manipulated to their ON positions. When one of the circuit breakers trips, all of the operating mechanisms, including the dummy operating mechanism, are unlatched, and the dummy movable contact arm moves to a second position corresponding to the OFF positions of the circuit breaker contact arms. In this second position, the dummy contact arm actuates the indicating circuit microswitch. Similarly, if the ganged operating handles are moved to their OFF positions, the operating handle in the accessorial case shifts the dummy contact arm to its second position to again actuate the microswitch.

In the shunt trip adaptation, a trip solenoid is incorporated in the accessorial case, such that upon energization its solenoid strikes the internal common trip bar or some extension thereof to trip all of the circuit breakers common thereto. It is common practice to incorporate a switch within the accessorial case to interrupt the solenoid energization circuit once tripping of the circuit breakers has been achieved. In this way, the trip solenoid is not required to carry continuous energizing current and thus can be of a light duty, inexpensive design. In practice, this trip solenoid de-energizing switch has taken the form of a conventional, off-the-shelf microswitch actuated from the common trip bar.

These miniature switches or microswitches utilized in trip alarm and shunt trip accessory devices add significantly to the expense of implementing these auxiliary functions. Moreover, unless of particularly high quality, these miniature switches are not particularly long-lived. Also, the practice of utilizing dummy circuit breaker parts solely for the purpose of achieving a switching function adds undue cost and complexity to the design of such accessory devices.

It is accordingly an object of the present invention to provide improved circuit breaker accessory devices for implementing various auxiliary functions.

A further object of the present invention is to provide accessory devices of the above character which utilize an improved auxiliary switch.

A further object is to provide an auxiliary switch of the above character requiring a minimum number of parts.

Yet another object of the present invention is to provide an auxiliary switch of the above character which is simple in design, inexpensive to manufacture and reliable in operation.

Other objects of the invention will in part be obvious and in part appear hereinafter.

SUMMARY OF THE INVENTION

In accordance with the present invention, there are provided circuit breaker accessory devices of both the operating and indicating types which incorporate an improved switch construction operating to control an auxiliary circuit in accordance with the condition of the circuit breaker or circuit breakers to which the accessory devices are adapted. The accessory device is housed in an accessorial molded circuit breaker case affixed in side-by-side relation with one or more molded case circuit breakers. The accessorial case mounts a movable handle which is tied to the operating handles of the circuit breakers. The accessory device is also operatively connected with the circuit breakers via an internal common trip bar. A lever is affixed to the end portion of this common trip bar extending into the accessorial case and carries one contact of an auxiliary switch. The accessorial case handle mounts the other switch contact to which one lead of the auxiliary circuit is electrically connected. The other lead of the auxiliary circuit is electrically connected to the lever mounted switch contact. The one auxiliary switch contact is variously positioned by the common trip bar, while the other is variously positioned by the accessorial case handle so as to selectively make and break the auxiliary circuit.

In one embodiment of the invention, a shunt trip solenoid is incorporated in the accessorial case and is electrically connected in series with the lead of the auxiliary circuit terminating at the handle mounted switch contact. As long as the accessorial case handle assumes a position corresponding to the ON position of the circuit breaker operating handles and the common trip bar is in its normal position, the auxiliary switch contacts inter-engage to complete the energization circuit for the shunt trip solenoid. Upon the application of an external voltage to this auxiliary circuit, the trip solenoid is energized, and its plunger impacts against the lever to shift the trip bar to its tripping position, thereby initiating a trip function by all of the circuit breakers common thereto. With the trip bar in its tripping position, the auxiliary switch contacts are separated to prevent needless continued energization of the trip solenoid.

In another embodiment of the invention, the auxiliary switch is implemented as normally closed switch to control the energization of a trip indicator. As long as the accessorial case handle is in its ON position and the trip bar is in its normal position, the switch contacts inter-engage to maintain an indicator, such as a pilot light, energized. This auxiliary switch opens to extinguish the pilot light and manifest that the circuit breaker or circuit breakers are in their OFF conditions if the accessorial case handle moves away from its ON position to either its tripped or OFF position. Irrespective of the position of the handle, the auxiliary switch opens when the trip bar moves to its tripping position, since this repositioning of the one switch contact is effective in and of itself to achieve contact separation.

The invention accordingly comprises the features of construction, combinations of elements, and arrangements of parts which will be exemplified in the description hereinafter set forth, and the scope of the invention will be indicated in the claims.

For a better understanding of the nature and objects of the invention, reference should be had to the following detailed description taken in connection with the accompanying drawings, in which:

FIG. 1 is a perspective view of a combination circuit breaker and accessory device constructed in accordance with the present invention;

FIG. 2 is a side elevational view of the circuit breaker of FIG. 1 with its case cover removed;

FIG. 3 is a side elevational view of the accessory device of FIG. 1 with its case cover removed;

FIG. 4 is a sectional view taken along line 4—4 of FIG. 3; and

FIG. 5 is a perspective view, partially broken away, of a portion of the accessory device of FIG. 3.

Corresponding reference numerals refer to like parts throughout the several views of the drawing.

DETAILED DESCRIPTION

Referring specifically to the drawings, FIG. 1 depicts a molded case circuit breaker, generally indicated at 10 and housed in a molded case 12, wherein the circuit breaker is equipped with an accessory device, generally indicated at 14 and also housed in a molded circuit breaker case 16. The circuit breaker and accessory device are ganged together in side-by-side relation by way of elongated tie bolts 17. It will be appreciated that while only one circuit breaker is illustrated, the accessory device of the present invention may serve two and three circuit breakers similarly ganged together for application in two and three-pole installations.

Circuit breaker 10 may be of the construction disclosed in U.S. Pat. No. 3,288,965. In order to promote a complete understanding of the present invention, it is deemed desirable to briefly review the circuit breaker construction of this patent with reference to FIG. 2 herein. Thus, circuit breaker 10 includes manual operating handle 20 which is pivotally supported in the circuit breaker case 12 by means of oppositely extending, integrally formed hub portions 21. Handle 20 includes a pair of spaced depending portions 22 straddling a generally planar cradle 24 pivotally supported in the circuit breaker case by means of opposed pivot pins 25. A movable contact arm 26 carries a movable contact 27 on its lower end and is bifurcated at its upper end to provide a pair of spaced leg portions 28 facilitating pivotal connection with the depending handle portions 22 at pivot bearings 29. A tension operating spring 30 is connected between the contact arm 26 and a hole 31 provided in cradle 24. A stationary contact 34 is carried by a depending line strap 35 integrally formed with terminal jaws 36 adapted for plug-on electrical engagement with a line stab in a circuit breaker load center (not shown).

It is seen that movement of the handle 20 between the "off" position, shown in solid, and the "on" position, shown in phantom, moves the pivot point 29 of contact arm 26 back and forth across the line of action of spring 30 to toggle the contact arm between open and closed circuit positions.

Cradle 24 is normally retained in its position shown in FIG. 2 by a latch 37 in the form of a tab struck from a depending armature 38 pivotally mounted at its upper end in the circuit breaker case 12. A spring 39 biases the depending portion of the armature to the left as seen in FIG. 2 to insure that the latch 37 is in position to engage the tip 40 of cradle 24 to releasably retain the operating mechanism in its untripped condition. It is seen that upon release of the cradle, the operating spring is effective to swing the cradle generally in a clockwise direction about its pivot pins 25, with the result that the line of action of the spring passes to the opposite side of the contact arm pivot point 29 in its phantom position of FIG. 2. As a consequence, the spring 30 is now effective to pivot the contact arm 26 to its solid line position shown in FIG. 2, thereby opening the circuit breaker internal circuit.

Included in the circuit breaker internal circuit is an elongated bimetal 42 which is mounted at its upper end to the inner end of a load strap 43 which extends outwardly from the case interior to facilitate connection with a load circuit using a binding head screw 44. The load strap is affixed to the circuit breaker case by a screw 45. Completing the circuit breaker internal circuit, a flexible braid 46 is connected between the contact arm 26 and the lower end of bimetal 42.

To effect a thermal trip function in response to overload currents, the lower end portion of bimetal 42 deflects to the right, as seen in FIG. 2, and this movement is communicated to the armature 38 via an armature hook 49. Corresponding rightward movement of the armature disengages the latch 37 from the cradle tip 38 to unlatch the operating mechanism and separate the circuit breaker contacts 27 and 34.

To accommodate a more rapid tripping function in response to heavy overload or short circuit currents, a generally U-shaped magnetic field piece 50 is mounted by the bimetal 42 in which sufficient flux is developed in response to excessive overload current flowing through the bimetal to attract armature 38 and similarly trip the circuit breaker operating mechanism.

In order that the circuit breaker seen in FIG. 2 may also be tripped externally, either from the accessory device 14 or from another of its companion single pole circuit breakers, a common trip bar 52 is introduced through an enlarged opening 53 in the case sidewall in proximity to armature 38. As will be seen, this trip bar also extends into the accessory device case 16 and into or through similar openings provided in the cases of other circuit breakers ganged with circuit breaker 10 and accessory device 14. Trip bar 52, common to all of the circuit breakers and the accessory device, is supported at points along its length by a latch actuating member 54 pivotally mounted by means of integral trunions 55 in each circuit breaker case. Actuating member 54 has a depending tip 56 positioned in near engaging relation with armature 38. It is seen that any force acting to move the common trip bar generally to the right as seen in FIG. 2 will precipitate rightward movement of armature 38, thereby unlatching the operating mechanism to effect circuit interruption. This movement of the common trip bar from its normal position to its rightmost tripping position can be initiated by the accessory device 14, as will be seen, or by one of the other circuit breakers to which the trip bar is common. In this latter, common tripping mode clearly described in the above-noted U.S. Pat. No. 3,288,965, when one of the circuit breakers trips automatically in response to an overcurrent condition in its phase of the load circuit, projection 24A of the unlatched cradle moves into engagement with the associated latch actuating member 54. The common trip bar 52 is thus forced to the right, and, since all of the latch actuating members of the ganged circuit breakers are tied together by the common trip bar, the armatures of all of the circuit breakers will be moved to the right to unlatch their associated operating mechanisms.

Turning now to FIG. 3, accessory device 14 includes a handle 60 which is pivotally mounted in its case 16 by way of integrally formed hub portions 61 in the same manner as the circuit breaker operating handle 20 is pivotally mounted in circuit breaker case 12 (FIG. 2). As seen in FIG. 1, handles 20 and 60 are ganged together by an external handle tie 62. It will be appreciated that handle tie 62 would also serve to physically interconnect the operating handles of additional circuit breakers ganged together with circuit breaker 10 and accessory device 14 via tie bolts 17. As best seen in FIG. 4, accessory device handle 60 also includes a pair of spaced depending portions 64 through which transversely aligned holes 65 are drilled. These holes serve to rotatably mount the end portions of an electrically conductive pin 66 which, as will be seen, constitutes one contact of an auxiliary switch. A connector 68 is formed at one end with an internal opening defined by inwardly radiating barbs **68*a* which engage the periphery of pin contact 66 to insure positive electrical connection therebetween. The other end of connector 68 is structured in the form of a sleeve 68*b* for receiving the insulation-free end of a lead 70. Sleeve 68*b* is crimped to provide positive electrical interconnection between lead 70 and connector 68.**

Lead 70 is connected to one terminal of a trip solenoid 72. The other terminal of the trip solenoid is brought out via lead 74 which exits the accessorial case 16 via a passage 76 normally serving as a vent passage when the case is utilized to house a circuit breaker. The other side of the trip solenoid energization circuit, constituted by lead 78, is brought into the accessorial case interior through passage 76. A strain relief member 79, lodged in passage 76, engages the leads 74 and 78 to take up forces tending to pull these leads from the accessorial case 16.

Still referring to FIG. 3, common trip bar 52 of FIG. 2 is introduced into the accessorial case 16 through a sidewall opening 80. An elongated lever 82, structured much like armature 38, is pivotally mounted in the accessorial case 16 at its upper end by means of laterally extending ears **82*a* (FIG. 5). An upwardly extending tab 84 struck from a central opening formed in the upper portion of lever 82 serves to cradle and thus pivotally support that portion of common trip bar 52 extending into accessorial case 16. Referring to FIGS. 3 and 5, an elongated, flexible auxiliary switch contact arm 86 extends through a slot 82*b* in lever 82 to provide a downwardly turned lower end portion lying against the back side of the lever to facilitate mounting of the switch arm thereto by suitable means such as welding. Lead 78 of the trip solenoid energization circuit is provided with an upwardly formed loop, such as to present a downwardly extending insulation-free end portion which is brazed to the mounted end portion of contact arm 86. The other, free end of auxiliary switch contact arm 86 is formed having an upwardly turned termination disposed to selectively electrically engage pin contact 66 and thus control energization of the trip solenoid 72 in accordance with the relative positions of the common trip bar 52 and the accessorial handle 60. Completing the structural details of the accessory device 14 of FIG. 3, an elongated insulating strip 90 is lodged in the accessorial case 16 to extend through the opening 91** normally accommodating a load strap when the case is utilized to house a circuit breaker.

Turning now to a description of the operation of the accessory device of the present invention, it is seen from FIG. 3 that as long as handle 60 assumes its extreme counterclockwise position corresponding to the ON position of the circuit breaker operating handle 20, and the trip bar 52 is in its normal position, contact arm 86 engages pin contact 66 to provide electrical continuity for the trip solenoid energization circuit. If the circuit breaker handle 20 moves clockwise to either its tripped or OFF position, the resulting clockwise movement of accessory device handle 60 swings pin contact 66 away from contact arm 86 to open the solenoid energization circuit. This is illustrated in FIG. 3, wherein pin contact 66 in its tripped position, indicated at **66*a*, and its OFF position, indicated at 66*b*, is spaced from contact arm 86.** As a consequence, the solenoid energization circuit is completed by the auxiliary switch only when the circuit breaker contacts are closed. It will be appreciated that actuation of the trip solenoid when the circuit breaker contacts are already open would serve no useful purpose. Thus, the auxiliary switch is effective to preclude such needless trip solenoid actuation.

With the auxiliary switch contacts closed and an external voltage applied across leads 74 and 78, trip solenoid 72 is energized to attract its plunger **72*a* to the right as seen in FIG. 3, forcing an actuating pin 92 into impact with lever 82. The lever is forcibly swung in a counterclockwise direction with the result that the common trip bar 52 is also swung to the right to effect tripping of all of the circuit breakers common thereto. In addition, contact arm 86 assumes the position shown in phantom at 86*a* which is effective to separate its upwardly turned terminal portion from pin contact 66.**

This contact separation to open the solenoid energization circuit is achieved regardless of whether or not the circuit breaker handle 20 moves to its trip position and thus pin contact 66 to its position 66*a*. Thus, sustained operation of the trip solenoid once it is fired is precluded even though accessory handle 60 is held in its extreme counterclockwise position. The phantom position 86*a* of the contact arm is sustained by virtue of the engagement of the unlatched circuit breaker cradle 24 with latch actuating member 54 (FIG. 2). When the circuit breaker handle is moved to its OFF position to reset its operating mechanism, the cradle releases latch actuating member 54 and the common trip bar 52 is returned to its normal position by way of armature 38 and armature return spring 39. Also assisting in the return of the common trip bar 52 to its normal position and lever 82 to its position shown in FIG. 3 is the resiliency of the loop formed in lead 78. It is found that these combined restoring forces are sufficient to return the trip solenoid plunger 72*a* and actuating pin 92 to their unactuated positions without benefit of a separate return spring. It is also pointed out at this juncture that the rotational mounting of the pin contact 66 by accessory handle 60 enables the connector 68 to pivot in response to handle movement and thus minimize bending stresses on the lead 70.

It will be appreciated that the auxiliary switch seen in FIG. 3 can be used alone to control a remote trip alarm indicator. In this application, the solenoid 72 is removed and lead 70 is made common with lead 74, as indicated in phantom at 70*a*. As long as the circuit breaker operating handle 20 is in its ON position and the common trip bar 52 is in its normal position, auxiliary switch contacts 66 and 86 are in engagement to complete the indicator circuit and, for example, energize a pilot light manifesting the circuit breaker 10 is closed. If the circuit breaker 10 is tripped or opened by manipulation of its operating handle, the auxiliary switch opens to extinguish the pilot light, manifesting the fact that the circuit breaker is open. It will be appreciated that the auxiliary switch may instead control a holding circuit for a separate indicator circuit, such that opening the auxiliary switch in response to opening of the circuit breaker precipitates energization of a pilot light or the sounding of an alarm.

From the foregoing description, it is seen that the present invention provides an improved accessory device incorporating an extremely simple auxiliary switch which is inexpensive to manufacture and reliable in operation. Thus the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

Having described our invention, what we claim as new and desire to secure by Letters Patent, is:

1. An accessory device for one or more molded case circuit breakers, wherein the circuit breaker includes an internal trip mechanism and an operating mechanism including a manual operating handle, said accessory device comprising, in combination:

A. an accessorial case affixed in side-by-side relation with the circuit breaker;

B. an accessorial handle pivotally mounted in said case;

C. an external handle tie rigidly interconnecting said accessorial handle and the circuit breaker operating handle;

D. a rigid internal trip bar having portions extending into the circuit breaker case and said accessorial case, said trip bar 1. actuatable externally of the circuit breaker for movement from a normal position to a tripping position effective to trip the circuit breaker, and
2. actuatable internally of the circuit breaker for movement from said normal position to said tripping position in response to tripping of the circuit breaker by its internal trip mechanism; and E. an auxiliary switch within said accessorial case, said switch including 1. a first contact variously positioned by said accessorial handle in following, via said handle tie, the movement of the circuit breaker handle, and
2. a second contact variously positioned by said trip bar in assuming said normal and tripping positions;
3. whereby said switch is effective to selectively control the energization of an auxiliary circuit in accordance with the relative positions of said accessorial handle and said trip bar.

2. The accessory device defined in claim 1, wherein said first contact is mounted by said accessorial handle for movement to positions of disengagement with said second contact as the circuit breaker handle moves to its tripped and OFF positions.

3. The accessory device defined in claim 1, wherein said second contact is mechanically connected to said trip bar for movement from a first position to a second position of disengagement with said first contact as said trip bar moves from its normal position to its tripping position.

4. The accessory device defined in claim 3, wherein said first contact is mounted by said accessorial handle for movement to position of disengagement with said second contact in its first position as the circuit breaker handle moves to its tripped and OFF positions.

5. The accessory device defined in claim 4, wherein said auxiliary switch further includes an elongated lever pivotally mounted at one end in said accessorial case, said lever including means engaging said trip such that said lever is movable with said trip bar in its movement between said normal and tripping positions, said second contact mounted to said lever adjacent its other end.

6. The accessory device defined in claim 5, wherein said second contact is in the form of an elongated contact arm mounted at one end to said lever and engageable with said first contact at a location adjacent its other end.

7. The accessory device defined in claim 6, wherein said first contact is in the form of a pin rotatably mounted by said accessorial handle.

8. The accessorial device defined in claim 3, which further includes a trip solenoid positioned in said accessorial case and electrically connected in the auxiliary circuit in series with said auxiliary switch contacts, said solenoid including a plunger operable upon energization of the auxiliary circuit to move said trip bar from its normal position to its tripping position, thereby tripping the circuit breaker and disengaging said switch contacts.

9. An accessory device for one or more molded case circuit breakers, wherein the circuit breaker includes an internal trip mechanism and an operating mechanism including a manual operating handle, said accessory device comprising, in combination:

A. an acccessorial case affixed in side-by-side relation with the circuit breaker;

B. an accessorial handle pivotally mounted in said case;

C. an external handle tie rigidly interconnecting said accessorial handle and the circuit breaker operating handle;

D. a rigid internal trip bar having portions extending into the circuit breaker case and said accessorial case; said trip bar movable between normal and tripping positions;

E. an auxiliary switch within said accessorial case, said switch including 1. a first contact variously positioned by said accessorial handle in following, via said handle tie, the movement of the circuit breaker handle, and 2. a second contact variously positioned by said trip bar in assuming said normal and tripping positions; and F. first and second auxiliary circuit leads extending into said accessorial case, said first lead electrically connected to said first switch contact and said second lead electrically connected to said second switch contact, G. whereby said switch is effective to selectively control the energization of the auxiliary circuit in accordance with the relative positions of said accessorial handle and said trip bar.

10. The accessory device defined in claim 9, wherein said second contact is mechanically connected to said trip bar for movement from a first position to a second position of disengagement with said first contact as said trip bar moves from its normal position to its tripping position, and said first contact is mounted by said accessorial handle for movement to positions of disengagement with said second contact in its first position as the circuit breaker handle moves to its tripped and OFF positions.

11. The accessory device defined in claim 10, wherein said auxiliary switch further includes an elongated lever pivotally mounted at one end in said accessorial case, said lever including means engaging said trip bar such that said lever is movable with said trip bar in its movement between said normal and tripping positions, said second contact being in the form of an elongated contact arm mounted at one end to the other end of said lever and engageable at a location adjacent its other end, with said first contact, said second auxiliary circuit lead electrically connected to said one end of said contact arm.

12. The accessory device defined in claim 11, wherein said first contact is in the form of a pin rotatably mounted by said accessorial handle, said accessory device further including a connector fixedly engaging said pin to electrically connect said first auxiliary circuit lead thereto.

13. The accessorial device defined in claim 12, which further includes a trip solenoid positioned in said accessorial case and electrically connected in series with said first auxiliary circuit lead, said solenoid including a plunger operable upon energization of the auxiliary circuit to engage said lever and forcibly move said trip bar from its normal position to its tripping position and said contact arm from its first position to its second position, thereby tripping the circuit breaker and disengaging said contact arm from said pin.

14. The accessory device defined to claim 13, wherein a segment of said second auxiliary circuit lead adjacent its electrical connection to said contact arm is in the form of a resilient loop acting on said lever to bias said trip bar toward its normal position and said contact arm toward its first position.

* * * * *

UNITED STATES PATENT OFFICE

CERTIFICATE OF CORRECTION

PATENT NO. : 3,973,230

DATED : August 3, 1976

INVENTOR(S) : Ronald D. Ciarcia and James E. McGann

It is certified that error appears in the above-identified patent and that said Letters Patent are hereby corrected as shown below:

Column 8, line 45, after the word "trip" insert --bar--

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*